US005183000A

United States Patent [19]

Burks

[11] Patent Number: 5,183,000

[45] Date of Patent: Feb. 2, 1993

[54] METHOD FOR CLEANING BOAT HULLS

[76] Inventor: Lonnie R. Burks, P.O. Box 112, New Blaine, Ark. 72851

[21] Appl. No.: 846,244

[22] Filed: Feb. 18, 1992

[51] Int. Cl.[5] ..... B63B 59/08

[52] U.S. Cl. ..... 114/222; 51/384

[58] Field of Search ..... 114/222; 15/DIG. 2; 51/4, 16, 24, 384, 391

[56] References Cited

U.S. PATENT DOCUMENTS 3,267,622 8/1966 Frostad ..... 51/384

4,084,534 4/1978 Rees ..... 51/24

*Primary Examiner*—Jesus D. Sotelo

*Attorney, Agent, or Firm*—Ray F. Cox, Jr.

[57] ABSTRACT

A method for cleaning the hull of a small boat, employing any of a number of portable hand-operated power tools in conjunction with any one of a number of common varieties of industrial grade, synthetic fiber scouring pads. The power driven scouring pad is applied to the surface of the boat hull using commonly available hand cleaners. According to the preferred embodiment of this invention, the most effective type of hand cleaner used on the portion of the boat hull below the water line is a pumice type hand cleaner. The type of hand cleaner that is most effetively used on the area of the boat hull above the water line is a cream type hand cleaner.

2 Claims, 1 Drawing Sheet

METHOD FOR CLEANING BOAT HULLS

BACKGROUND OF THE INVENTION

This invention relates to a method for use in cleaning the hull of a small boat.

Small boats employed on inland waterways often suffer from a build-up of materials such as algae, silt and slime whose build-up both detracts from the performance of the boat and from its appearance. As a result, such boats must be cleaned periodically.

In order to prevent or inhibit the development of this problem various measures may be taken such as the use of anti-fouling paints. However, the most common practice is to clean the boat hull mechanically at periodic intervals to remove the accumulated materials and to restore the boat to its original appearance.

A number of attempts have been made to develop implements or methods for cleaning a boat hull while the boat remains submerged in the water. Examples of devices developed for this purpose are U.S. Pat. No. 4,991,533 issued to Sterling on Feb. 12, 1991 for "Boat Bottom Cleaning Device" and U.S. Pat. No. 4,407,213 issued to Evans on Oct. 4, 1983 for "Cleaning Implement for Boats." The difficulty inherent, however, in cleaning a boat while the boat remains in the water are obvious. It has been a common practice, therefore, to clean boat hulls after they have been removed from the water by either using mechanical implements to remove the accumulated material or to use acid based hull cleaners or a combination of the two. The use of acid based hull cleaners presents a significant hazard to those who use this cleaning material and its efficiency is inconsistent when used on various types of boat hulls and various accumulated fouling materials.

SUMMARY OF THE INVENTION

It is an object of the present invention to provide a simple, safe and effective method for cleaning a boat hull of accumulated fouling materials.

It is a further object of the present invention to provide for a method of cleaning boat hulls using readily available materials.

It is an additional object of the present invention to provide for a method of cleaning boat hulls which is effective in removing accumulated materials while avoiding damage to the boat hull itself.

The method of the present invention employs any of a number of portable, hand-operated power tools in conjunction with any one of a number of common varieties of industrial grade synthetic fiber scouring pads. The power driven scouring pad is applied to the surface of the boat hull using commonly available hand cleaners. According to the preferred embodiment of this invention, the most effective type of hand cleaner used on the portion of the boat hull below the water line is a pumice type hand cleaner. The type of hand cleaner that is most effectively used on the area of the boat hull above the water line is a cream type hand cleaner.

Further objects and advantages of the present invention will become apparent from the following detailed description of the preferred embodiment and appended claims in conjunction with the drawings.

DESCRIPTION OF THE PREFERRED EMBODIMENT

The practice of the method of the preferred invention requires the use of any of a number of a standard industrial grade, synthetic fiber scouring pads. Such scouring pads are normally made of a synthetic nylon fiber which provides a very satisfactory type of roughened surface for effectively removing accumulations of fouling materials from a boat hull. These scouring pads are available in a variety of shapes and thicknesses. It has been found that a thickness of approximately $\frac{5}{8}$ of an inch is durable and effective.

Figure 1:
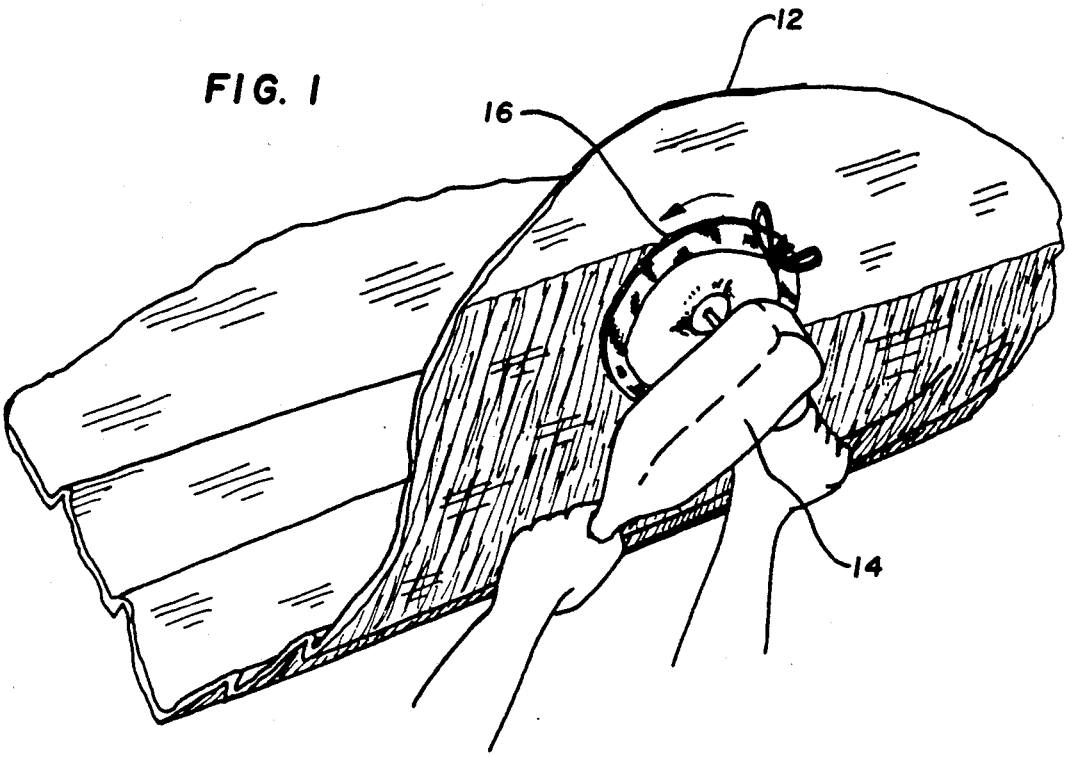
FIG. 1 is a sectional view of a portion of a small boat hull showing the employment of the methodology of the present invention.
Figure 2:
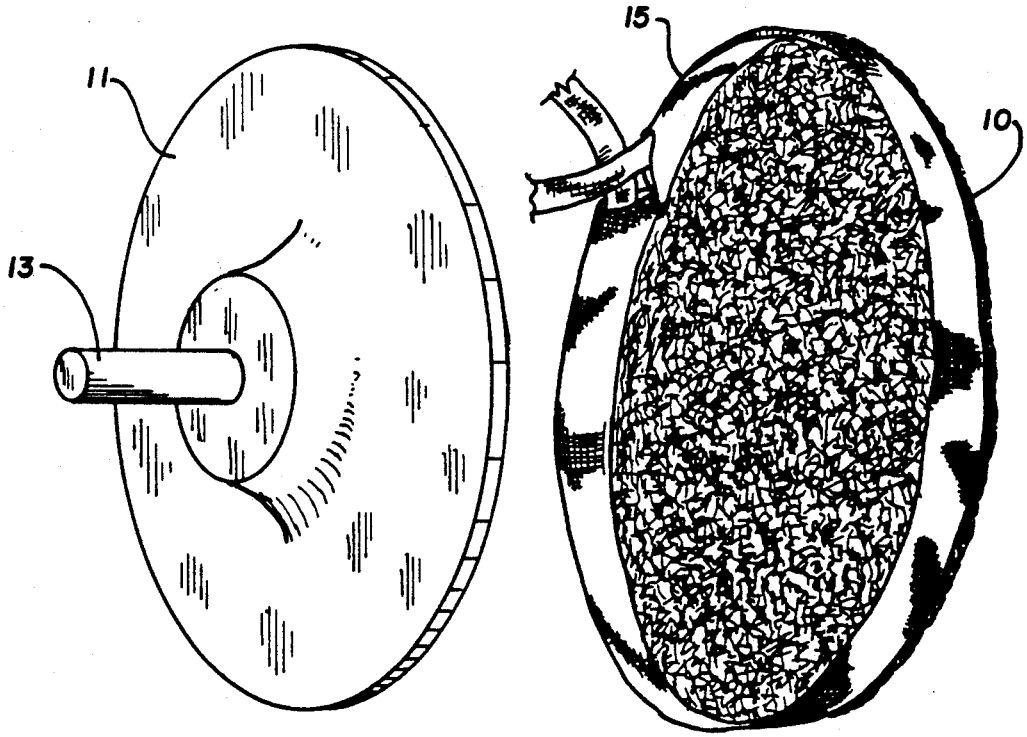
FIG. 2 is a perspective view showing the scouring pad employed in the present invention and its means of attachment to a flexible backup pad.

With reference to FIG. 2, it is necessary to attach the scouring pad 10 to a backup pad 11. The backup pad 11 may be the type of flexible rubber pad commonly used in conjunction with hand-held buffer/polishers or flexible disk sanders. It is important that whatever type of backup pad is chosen it should be sufficiently flexible to follow the contours of the boat hull 12 as shown in FIG. 1.

The backup pad 11 must also be equipped with means to drive the backup pad 11 in a rotary motion. A drive shaft 13 may be a drill arbour or any other means for attaching the backup pad 11 to a portable hand tool of the type capable of imparting a rotary motion to the backup pad 11. With reference to FIG. 1, such a portable hand operated power tool is designated generically as 14.

Referring again to FIG. 2, the scouring pad 10 may be attached to the backup disk 11 by any of a number of means that would act to secure the scouring pad 10 to the disk 11 so that no separation occurs when the scouring pad 10 is driven against the boat hull 12. Possible attachment methods include the use of adhesives or velcro type fasteners. However, in the preferred embodiment a drawstring apparatus 15 is secured to the scouring pad 10. By means of the drawstring apparatus 15, the scouring pad 10 is secured to the flexible backup pad 11 to form a scouring assembly 16 as shown in FIG. 1.

Having mounted the scouring assembly 16 to the portable hand-operated power tool 14, the boat hull 12 may be removed from the water and sufficient time allowed for the boat hull to dry. In one embodiment of the present invention, the scouring assembly 16 may be applied to the boat hull 12 in a rotary motion imparted by the power tool 14 while the boat hull is wet or partially dry. In an alternative embodiment, the scouring assembly 16 may be applied without the use of any other cleaning materials. However, in the preferred embodiment of the present invention, any of a variety of commonly available hand cleaners may be applied to the boat hull 12 to assist in the cleaning process. It has been determined that a pumice type hand cleaner works best when applied to the portions of the boat hull below the water line, while a cream type hand cleaner works best on the portions of the boat hull above the water line.

The method of the present invention works best when the scouring assembly 16 is applied at low speed to the boat hull 12. Higher speeds tend to sling both hand cleaner and hull deposits as material is loosened from the hull. As the final step in the preferred embodiment of the present invention, the boat hull is rinsed.

The method of the present invention has been found to be effective on both fiberglass boats and aluminum boats. The present method has been proven to be both effective and to provide a distinct safety advantage by avoiding the use of acid type cleaners.

What is claimed is:

1. A method for cleaning while out of the water a boat hull having surface areas above and below a water line, comprising the steps of:

affixing an industrial grade synthetic fiber scouring pad to a flexible backup pad having a driving shaft;

attaching a scouring assembly comprising said scouring pad and said backup pad to a portable, hand-operated power tool having means for engaging a driving shaft by engaging said driving shaft with said means for engaging a driving shaft;

removing the boat hull from the water;

allowing sufficient time for the boat hull to dry;

applying a pumice hand cleaner to the surface area of the boat hull below the water line;

applying a cream hand cleaner to the surface area of the boat hull above the water line;

driving said scouring assembly in a rotary motion with said power tool at low speed while applying said scouring pad to the surface areas of the boat hull until the boat hull is clean; and rinsing the boat hull.

2. A method as set forth in claim 1 wherein said step of affixing an industrial grade synthetic fiber scouring pad to a flexible backup pad having a drive shaft comprises the steps of:

affixing a drawstring assembly to said scouring pad; and securing said drawstring assembly about said backup pad.

* * * * *